US007320228B2

(12) United States Patent
Kamimura et al.

(10) Patent No.: US 7,320,228 B2
(45) Date of Patent: Jan. 22, 2008

(54) REFRIGERANT CYCLE APPARATUS

(75) Inventors: Ichiro Kamimura, Gunma (JP); Hiroshi Mukaiyama, Gunma (JP); Satoshi Imai, Gunma (JP); Hiroyuki Itsuki, Gunma (JP); Masahisa Otake, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 191 days.

(21) Appl. No.: 11/202,204

(22) Filed: Aug. 12, 2005

(65) Prior Publication Data

US 2006/0032267 A1 Feb. 16, 2006

(30) Foreign Application Priority Data

Aug. 12, 2004 (JP) ..... 2004-235405

(51) Int. Cl.
*F25B 1/00* (2006.01)

(52) U.S. Cl. ..... 62/498; 62/510

(58) Field of Classification Search ..... 62/498, 62/510, 511

See application file for complete search history.

(56) References Cited

U.S. PATENT DOCUMENTS

| | | | | |
|---|---|---|---|---|
| 2,697,659 | A * | 12/1954 | Macintire | 71/25 |
| 2,888,809 | A * | 6/1959 | Rachfal | 62/196.3 |
| 3,493,012 | A | 2/1970 | Webb | |
| 4,742,694 | A | 5/1988 | Yamanaka et al. | |

FOREIGN PATENT DOCUMENTS

| | | |
|---|---|---|
| EP | 0 424 003 A2 | 10/1989 |
| EP | 1 207 359 A2 | 11/2001 |
| EP | 1 207 359 A3 | 11/2001 |
| JP | 57-124664 | 8/1982 |
| JP | 07-110167 | 4/1995 |
| JP | 2804527 | 7/1998 |
| JP | 11-142024 | 5/1999 |
| JP | 2001-296067 | 10/2001 |
| JP | 2002-349979 | 12/2002 |
| JP | 2003-74999 | 3/2003 |
| JP | 2003-279198 | 10/2003 |
| JP | 2004-085103 | 3/2004 |
| JP | 2004-85104 | 3/2004 |

OTHER PUBLICATIONS

European Search Report for Corresponding Application No. 05017389.7-2301, Date Jul. 28, 2006.

Japanese Office Action, issued in corresponding Japanese Patent Application No. 2004-235405, dated on Jul. 31, 2007.

* cited by examiner

*Primary Examiner*—Melvin Jones
(74) *Attorney, Agent, or Firm*—McDermott Will & Emery LLP

(57) ABSTRACT

In a refrigerant cycle apparatus which is operated at a supercritical pressure on a high-pressure side, for a purpose of maintaining or enhancing performances or reducing generation of clogging or a dimension of a capillary tube, a compressor has a first compression element, and a second compression element which compresses a refrigerant compressed by the first compression element, a gas phase refrigerant in an intermediate pressure receiver is sucked into the second compression element of the compressor, a liquid phase refrigerant in the intermediate pressure receiver is pressure reduced in a second pressure reducing device, and introduced into an evaporator, and the first pressure reducing device comprises a capillary tube on an upstream side of the refrigerant, and throttling means on a downstream side of the capillary tube.

4 Claims, 6 Drawing Sheets

REFRIGERANT CYCLE APPARATUS

BACKGROUND OF THE INVENTION

The present invention relates to a refrigerant cycle apparatus in which a compressor, a radiator, a first pressure reducing device, an intermediate pressure receiver, a second pressure reducing device, and an evaporator are successively connected to one another in an annular form to constitute a refrigerant circuit and which is operated at a supercritical pressure on a high-pressure side.

In this type of conventional refrigerant cycle apparatus, for example, an air conditioner for cooling air in a room, a compressor, a radiator, a pressure reducing device, an evaporator and the like have heretofore been connected to one another in an annular form via piping to constitute a refrigerant cycle. Moreover, a refrigerant gas is sucked into a compression element of the compressor, and is compressed to form the refrigerant gas having high temperature and pressure. The gas is discharged, and flows into the radiator. In the radiator, a refrigerant radiates heat. The refrigerant which has flown out of the radiator is throttled by the pressure reducing device, and is supplied to the evaporator. In the evaporator, the refrigerant evaporates, and absorbs heat from its periphery to exert a cooling function and cool the inside of the room.

In recent years, in order to deal with a global environmental problem, also in this type of refrigerant cycle, an apparatus has been developed in which carbon dioxide ($CO_2$) as a natural refrigerant is used as the refrigerant without using conventional chlorofluorocarbon and which is operated at a supercritical pressure on a high-pressure side (see Japanese Patent No. 2804527).

In this type of refrigerant cycle apparatus, when a temperature of a heat source for exchanging the heat with the refrigerant rises in the radiator, refrigerating effects remarkably decrease, and the pressure on the high-pressure side needs to be raised in order to compensate for the decrease. As a result, there has been a problem that a compressive power increases and performances degrade.

Moreover, since the carbon dioxide refrigerant has a less pressure loss as compared with another refrigerant, a pressure reducing degree has to be increased in the pressure reducing device. However, when a usual electronic expansion valve is used as such pressure reducing device, it is difficult to obtain desired throttling effects, and an appropriate control could not be performed.

On the other hand, when a capillary tube is used as the pressure reducing device, a length of the capillary tube has to be increased, or an inner diameter thereof has to be reduced in order to obtain desired pressure reducing effects. However, when the inner diameter is excessively reduced, the capillary tube is clogged with sludge, water content, or oil, and there is a possibility that a trouble is generated in refrigerant circulation. However, when the desired pressure reducing effects are to be obtained by a usual capillary tube having an inner diameter of 0.6 mm, the length of the tube becomes 20 m or more.

SUMMARY OF THE INVENTION

The present invention has been developed in order to solve a conventional technique problem, and performances are maintained or enhanced, and generation of clogging or a dimension of a capillary tube is reduced in a refrigerant cycle apparatus which is operated at a supercritical pressure on a high-pressure side.

According to a first aspect of the present invention, there is provided a refrigerant cycle apparatus in which a compressor, a radiator, a first pressure reducing device, an intermediate pressure receiver, a second pressure reducing device, and an evaporator are successively connected to one another in an annular form to constitute a refrigerant circuit and which is operated at a supercritical pressure on a high-pressure side, wherein the compressor has a first compression element and a second compression element which compresses a refrigerant compressed by the first compression element; a gas phase refrigerant in the intermediate pressure receiver is sucked into the second compression element of the compressor; a liquid phase refrigerant in the intermediate pressure receiver is pressure reduced by the second pressure reducing device and is then introduced into the evaporator; and the first pressure reducing device comprises a capillary tube on an upstream side of the refrigerant and throttling means on a downstream side of the capillary tube.

A second aspect of the present invention is directed to the above refrigerant cycle apparatus wherein an inner diameter of the capillary tube is set to 0.1 mm or more and 0.4 mm or less.

A third aspect of the present invention is directed to the above refrigerant cycle apparatus wherein the throttling means of the first pressure reducing device comprises an expansion valve.

A fourth aspect of the present invention is directed to the above refrigerant cycle apparatus wherein the throttling means of the first pressure reducing device comprises a capillary tube.

A fifth aspect of the present invention is directed to the above refrigerant cycle apparatus wherein carbon dioxide is introduced as the refrigerant into the apparatus.

According to the present invention, a refrigerant flow rate of the first compression element is decreased to reduce a compressive power, and a performance coefficient can be enhanced. Since the refrigerant flow rate in the evaporator drops, a pressure loss in the evaporator is reduced, and performances are enhanced. Furthermore, since an amount of the liquid phase refrigerant in the evaporator increases, heat conducting performances are enhanced, and general performances can be enhanced.

Especially, since the first pressure reducing device comprises the capillary tube on the upstream side of the refrigerant and the throttling means on the downstream side of the capillary tube, the refrigerant having a supercritical state is pressure reduced by the capillary tube. The refrigerant having the supercritical state has superior dissolving characteristics. Therefore, even when the inner diameter of the capillary tube is reduced to 0.1 mm or more and 0.4 mm or less as in the second invention, clogging with sludge, water content, and oil is not easily caused. Therefore, even when carbon dioxide is used as the refrigerant as in the fifth invention, and a pressure reducing degree has to be set to be large, a length of the capillary tube can be shortened to improve a space efficiency.

Moreover, when the throttling means of the first pressure reducing device comprises the expansion valve as in the third invention, a pressure resistance of the expansion valve may be low because of the capillary tube on the upstream side of the refrigerant. Furthermore, when the throttling means of the first pressure reducing device comprises the capillary tube as in the fourth invention, the pressure is reduced by the capillary tube on the upstream side. Therefore, even when a capillary tube having a usual inner diameter is used in the capillary tube on the downstream side, the dimension of the tube does not have to be lengthened.

DETAILED DESCRIPTION OF THE PREFERRED EMBODIMENTS

According to the present invention, in a refrigerant cycle apparatus which is operated at a supercritical pressure on a high-pressure side, main characteristics lie in that performances be maintained or enhanced, and generation of clogging or a dimension of a capillary tube be reduced. To realize a purpose of maintaining or enhancing the performances, a gas phase refrigerant in an intermediate pressure receiver is sucked into a second compression element of a compressor, a liquid phase refrigerant in the intermediate pressure receiver is pressure reduced by a second pressure reducing device, and the refrigerant is introduced into an evaporator. To realize a purpose of reducing the generation of the clogging or the dimension of the capillary tube, the first pressure reducing device comprises a capillary tube on an upstream side of the refrigerant, and throttling means on a downstream side of the capillary tube, and an inner diameter of the capillary tube is set to 0.1 mm or more and 0.4 mm or less. Embodiments of the present invention will be described hereinafter in more detail with reference to the drawings.

Embodiment 1

Figure 1:
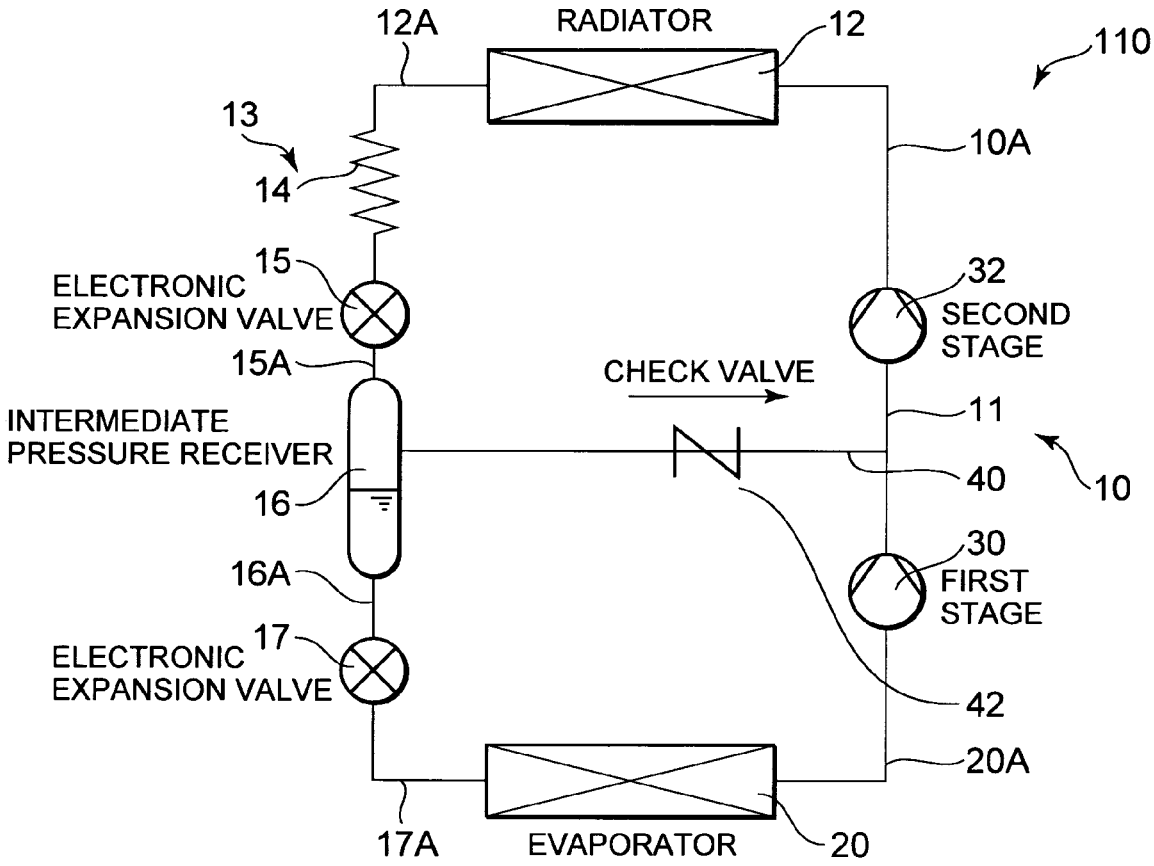
FIG. 1 is a refrigerant circuit diagram of a refrigerant cycle apparatus according to one embodiment of the present invention.

FIG. 1 is a refrigerant circuit diagram of a refrigerant cycle apparatus 110 according to one embodiment of the present invention. In the refrigerant cycle apparatus 110 of the present embodiment, a compressor 10, a radiator 12, a first pressure reducing device 13, an intermediate pressure receiver 16, a second pressure reducing device 17, and an evaporator 20 are successively connected to one another in an annular form to constitute a refrigerant circuit. That is, a refrigerant discharge tube 10A of the compressor 10 is connected to an inlet of the radiator 12.

Here, the compressor 10 of the present embodiment is a compressor of a two-stage compression system, having a first compression element 30 and a second compression element 32 for compressing a refrigerant compressed by the first compression element 30. In a sealed container (not shown), there are arranged a driving element, and the first compression element 30 and the second compression element 32 which are driven by the driving element.

In the figure, reference numeral 11 denotes a refrigerant introducing tube for discharging to the outside of the sealed container the refrigerant compressed by the first compression element 30 (first stage) of the compressor 10, and introducing the refrigerant into the second compression element 32 (second stage). A communicating tube 40 described later is connected midway to this refrigerant introducing tube 11.

Moreover, a refrigerant pipe 12A extending out of the radiator 12 is connected to an inlet of the first pressure reducing device 13. Here, the first pressure reducing device 13 is constituted of a capillary tube 14, and an electronic expansion valve 15 which is throttling means. The capillary tube 14 is disposed on an upstream side of the refrigerant, and the expansion valve 15 is disposed on a downstream side of the capillary tube 14. That is, the refrigerant whose heat has been radiated by the radiator 12 is pressure reduced by the capillary tube 14 disposed on the upstream side in the first pressure reducing device 13, and is thereafter pressure reduced by the expansion valve 15 disposed on the downstream side. An inner diameter of the capillary tube 14 is set to 0.1 mm or more and 0.4 mm or less, and a dimension thereof is set to 0.5 m or more and 5 m or less.

On the other hand, a refrigerant pipe 15A connected to an outlet of the first pressure reducing device 13 (expansion valve 15) reaches an inlet of the intermediate pressure receiver 16. This intermediate pressure receiver 16 separates a gas and a liquid of the refrigerant. After the refrigerant is pressure reduced by the first pressure reducing device 13 to constitute a two-phase mixture of the gas and the liquid, a liquid phase refrigerant is once stored in the intermediate pressure receiver 16. An upper part of the intermediate pressure receiver 16 is connected to the above-described communicating tube 40. This communicating tube 40 returns to the radiator 12 a gas phase refrigerant separated from the liquid phase refrigerant by the intermediate pressure receiver 16, and a check valve 42 is disposed in a middle portion of the communicating tube 40, assuming that a direction of the refrigerant introducing tube 11 is a forward direction. Accordingly, the gas phase refrigerant separated from the liquid phase refrigerant by the intermediate pressure receiver 16 passes through the communicating tube 40, and reaches the refrigerant introducing tube 11 of the radiator 12. The refrigerant is combined with a refrigerant gas compressed by the first compression element 30 and having an intermediate pressure, and is sucked into the second compression element 32.

On the other hand, a bottom surface of the intermediate pressure receiver 16 is connected to a refrigerant pipe 16A which reaches an inlet of the electronic expansion valve 17 as the second pressure reducing device. The liquid phase refrigerant, separated from the gas phase refrigerant and once stored in the intermediate pressure receiver 16, flows from the refrigerant pipe 16A into the expansion valve 17. A pipe 17A extending out of the second pressure reducing device 17 is connected to an inlet of the evaporator 20.

Moreover, an outlet side of the evaporator 20 is connected to a refrigerant introducing tube 20A of the compressor 10 to constitute an annular cycle for returning to the compressor 10.

As the refrigerant of the refrigerant cycle apparatus 110, carbon dioxide ($CO_2$) which is a natural refrigerant is used in consideration of eco-friendliness, combustibility, toxicity or the like. As a lubricant oil, polyalkylene glycol (PAG), polyol ester (POE) or the like is used.

Figure 2:
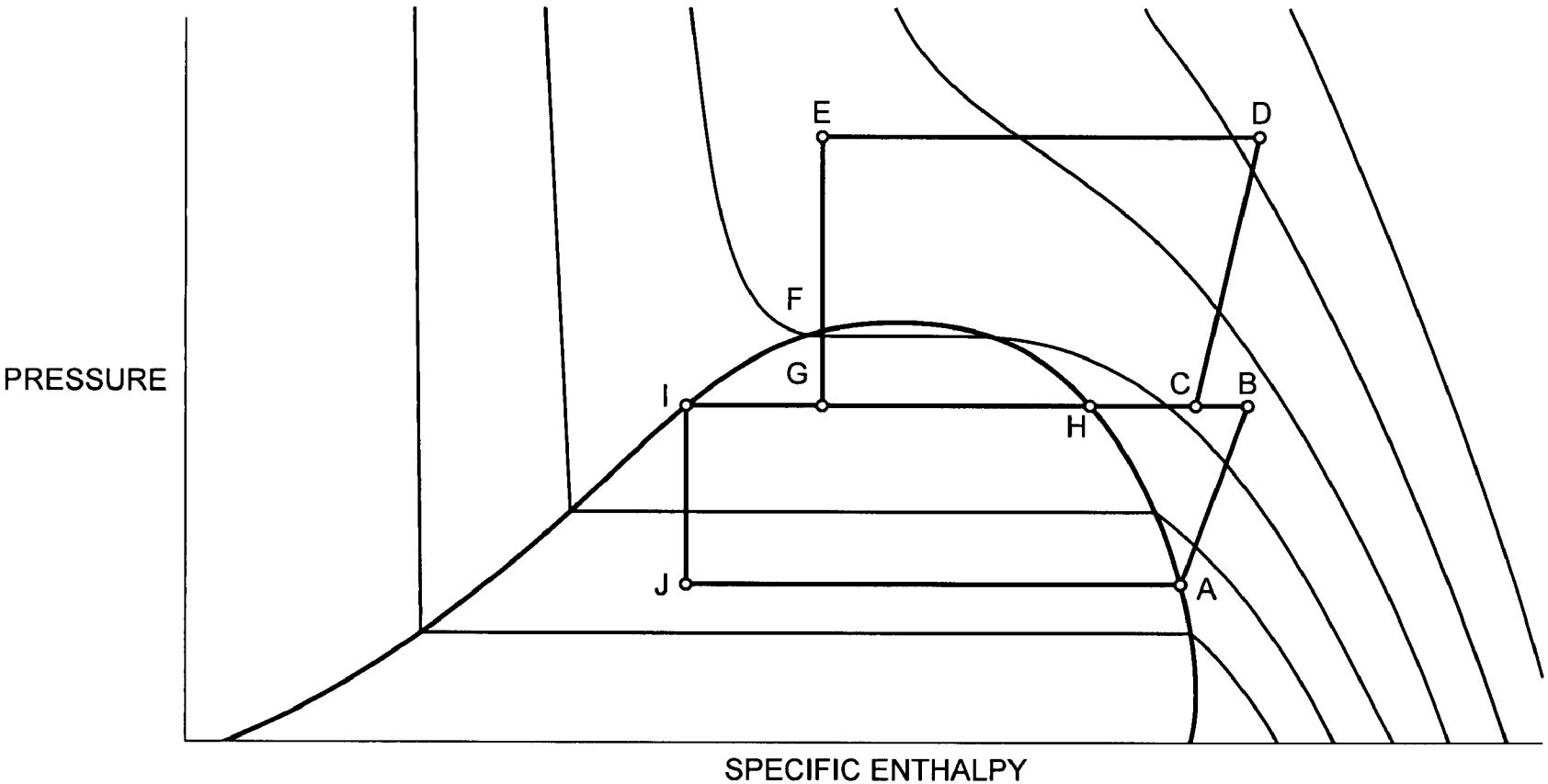
FIG. 2 is a p-h diagram of the refrigerant cycle apparatus of FIG. 1.

Next, an operation of the refrigerant cycle apparatus 110 constituted as described above will be described with reference to FIG. 2 which is a p-h diagram (Mollier chart). When a driving element (not shown) of the compressor 10 is driven by a control device (not shown), a low-pressure refrigerant gas is sucked into the first compression element 30 of the compressor 10 (state A of FIG. 2), and is compressed to constitute an intermediate-pressure refrigerant gas (state B of FIG. 2). Moreover, the intermediate-pressure refrigerant gas is sucked into the second compression element 32 via the refrigerant introducing tube 11. At this time, the temperature of the intermediate-pressure refrigerant gas drops by the combination with the gas phase refrigerant from the intermediate pressure receiver 16 described later, and a state C of FIG. 2 is achieved. Moreover, the refrigerant sucked into the second compression element 32 is compressed in a second stage to constitute a refrigerant gas having high temperature and pressure, and is discharged from the refrigerant discharge tube 10A to the outside. In this case, the refrigerant is compressed to an appropriate supercritical pressure (the pressure is about 7 MPa at a rating time, but ranges from 5 MPa to 11 MPa depending on environmental conditions) (state D of FIG. 2).

The refrigerant gas discharged from the refrigerant discharge tube 10A flows into the radiator 12, and heat is radiated by an air or water cooling system. In the radiator 12, the carbon dioxide refrigerant is condensed, and maintains its supercritical state without being liquefied, the temperature drops, and state E of FIG. 2 is obtained.

The refrigerant whose heat is radiated by the radiator 12 reaches the first pressure reducing device 13 via the refrigerant pipe 12A. By this first pressure reducing device 13, the refrigerant first flows into the capillary tube 14 disposed on the upstream side, and the pressure drops while the refrigerant passes through the capillary tube 14 (state F of FIG. 2).

Here, the refrigerant which has flown out of the radiator 12 has the supercritical state. Therefore, the refrigerant maintains its supercritical state in the capillary tube 14. Alternatively, the refrigerant is pressure reduced while maintaining its supercritical state in most of steps in which the refrigerant passes through the capillary tube 14 except that the refrigerant is formed into the two-phase mixture of the gas and liquid phases in the vicinity of the outlet of the capillary tube 14.

The refrigerant having such supercritical state has superior dissolving characteristics. Therefore, even when the inner diameter of the capillary tube 14 is set to be small in a range of 0.1 mm or more and 0.4 mm or less, the clogging with sludge, water content, and oil is not easily caused.

When a conventional chlorofluorocarbon-based refrigerant is used, a capillary tube having an inner diameter of about 0.6 mm is usually used. When the inner diameter is further reduced, the tube is clogged with the sludge, water content, and oil, and there is a possibility that a trouble is generated in circulating the refrigerant.

However, carbon dioxide is used as the refrigerant, and the pressure of the refrigerant to be introduced into the capillary tube 14 is brought into the supercritical state. Accordingly, the refrigerant having the supercritical state is pressure reduced in the capillary tube 14. Because of the superior dissolving characteristics peculiar to such supercritical state, the inner diameter of the capillary tube 14 can be reduced to 0.1 mm or more and 0.4 mm or less. Consequently, even by use of the carbon dioxide refrigerant having a less pressure loss, it is possible to avoid a disadvantage that the trouble is generated in such refrigerant circulation, the dimension of the capillary tube 14 can be reduced, and sufficient throttling effects can be obtained in the capillary tube 14.

Therefore, even when carbon dioxide is used as the refrigerant, and a large pressure reducing degree is required, a length of the capillary tube 14 can be shortened to improve a space efficiency.

Moreover, since the refrigerant can be sufficiently pressure reduced by the capillary tube 14, the usual electronic expansion valve 15 can be disposed on the downstream side of the capillary tube 14 to reduce the refrigerant pressure. Moreover, a pressure resistance of the expansion valve 15 may be low.

It is to be noted that the refrigerant pressure reduced by the capillary tube 14 flows into the expansion valve 15 disposed on the downstream side of the capillary tube 14, and is formed into the two-phase mixture of the gas and liquid by a pressure drop in the expansion valve 15 (state G of FIG. 2) before reaching the intermediate pressure receiver 16. In the intermediate pressure receiver 16, the pressure of the refrigerant drops to about 3 MPa to 4 MPa by the pressure reducing effects in the first pressure reducing device 13. Moreover, in the intermediate pressure receiver 16, the refrigerant is separated into a gas phase refrigerant (saturated steam) and a liquid phase refrigerant (saturated liquid). The gas phase refrigerant obtains state H of FIG. 2 in the intermediate pressure receiver 16. The refrigerant is returned to the refrigerant introducing tube 11 of the compressor 10 via the communicating tube 40, and is combined with the intermediate-pressure refrigerant compressed by the first compression element 30. In this case, the refrigerant obtains the state C of FIG. 2.

As described above, the gas and liquid of the refrigerant are separated in the intermediate pressure receiver 16, and a gas component is returned from the communicating tube 40 into the refrigerant introducing tube 11 of the radiator 12. Accordingly, the gas component which does not contribute to cooling is not circulated in the refrigerant circuit on a low-pressure side in and after the intermediate pressure receiver 16. An efficiency of a refrigerant cycle can be enhanced by this component. Especially, by use of the carbon dioxide refrigerant as in the present invention, the gas phase refrigerant separated in the intermediate pressure receiver 16 increases as compared with the conventional chlorofluorocarbon-based refrigerant. When the gas phase refrigerant is introduced from the refrigerant introducing tube 11 of the compressor 10 into the second compression element 32, the efficiency can further be enhanced.

On the other hand, the liquid phase refrigerant is once stored in the intermediate pressure receiver 16, and obtains state I of FIG. 2. The refrigerant flows out of the intermediate pressure receiver 16 via the refrigerant pipe 16A disposed in a bottom part, and is further throttled by the expansion valve 17 to obtain state J of FIG. 2.

The refrigerant whose pressure has dropped in the second pressure reducing device 17 flows into the evaporator 20 via the pipe 17A. In the evaporator, the refrigerant evaporates, and absorbs heat from its periphery to exert a cooling function.

Thereafter, the refrigerant which has flown out of the evaporator 20 is sucked from the refrigerant introducing tube 20A of the compressor 10 into the first compression element 30 to repeat its cycle (state A of FIG. 2).

As described above, in the intermediate pressure receiver 16, the gas phase refrigerant is sucked into the second compression element 32 of the compressor 10. The liquid phase refrigerant in the intermediate pressure receiver 16 is pressure reduced by the expansion valve 17 which is the second pressure reducing device. Thereafter, the refrigerant is introduced into the evaporator 20. Therefore, a refrigerant flow rate of the first compression element 30 can be decreased. Accordingly, a compressive power in the first compression element 30 can be reduced, and a performance coefficient can be enhanced.

Moreover, since the refrigerant flow rate in the evaporator 20 drops, the pressure loss in the evaporator 20 is reduced, and the performances are enhanced.

Furthermore, since the amount of the liquid phase refrigerant in the evaporator 20 increases, heat conducting performances are enhanced, and general performances can be enhanced.

Embodiment 2

Figure 3:
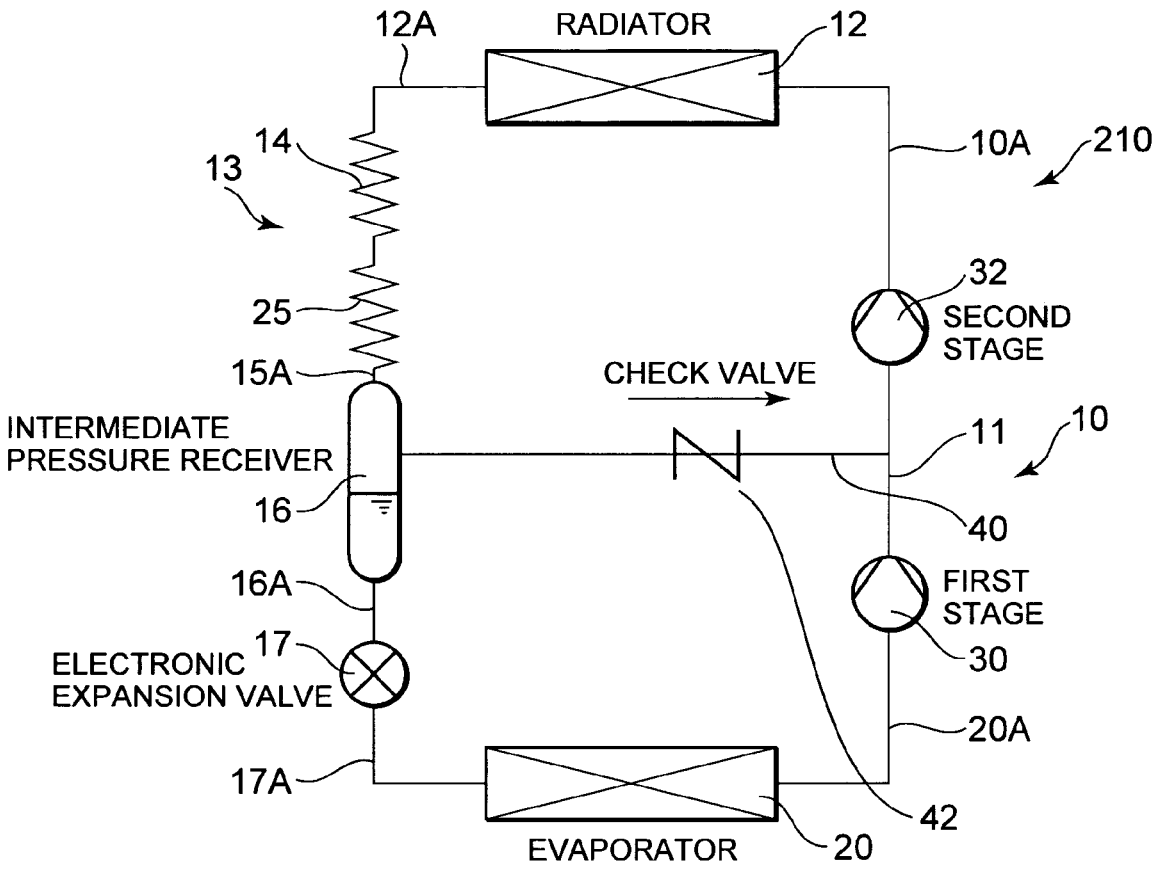
FIG. 3 is a refrigerant circuit diagram of a refrigerant cycle apparatus according to a second embodiment of the present invention.

Next, a second embodiment of a refrigerant cycle apparatus according to the present invention will be described. FIG. 3 is a refrigerant circuit diagram of a refrigerant cycle apparatus 210 of the present embodiment. It is to be noted that, in FIG. 3, components denoted with the same reference numerals as those of FIG. 1 produce identical or similar effects.

In FIG. 3, reference numeral 25 denotes a capillary tube which is throttling means of a first pressure reducing device 13 in the present embodiment. This capillary tube 25 has an inner diameter of 0.5 mm or more and 6 mm or less, and a dimension of 0.5 m or more and 2 m or less, and has heretofore been used.

That is, as described above in detail in the first embodiment, a refrigerant having a supercritical state is first pressure reduced by a capillary tube 14 having a small inner diameter, and accordingly the refrigerant can be sufficiently pressure reduced. Therefore, even when the conventional tube is used as the capillary tube 25 on the downstream side of the capillary tube 14, the dimension of the tube does not have to be lengthened. Consequently, even by use of the capillary tube 25, it is possible to avoid a disadvantage that a refrigerant circuit of the refrigerant cycle apparatus 210 is enlarged, and a space efficiency can be improved.

It is to be noted that an operation of the refrigerant cycle apparatus 210 of the present embodiment is similar to that of the first embodiment, and description thereof is therefore omitted.

Embodiment 3

The present invention is not limited to the above-described embodiment in which a second pressure reducing device comprises an electronic expansion valve. For example, as shown in FIG. 4, the second pressure reducing device may comprise a conventional capillary tube.

Figure 4:
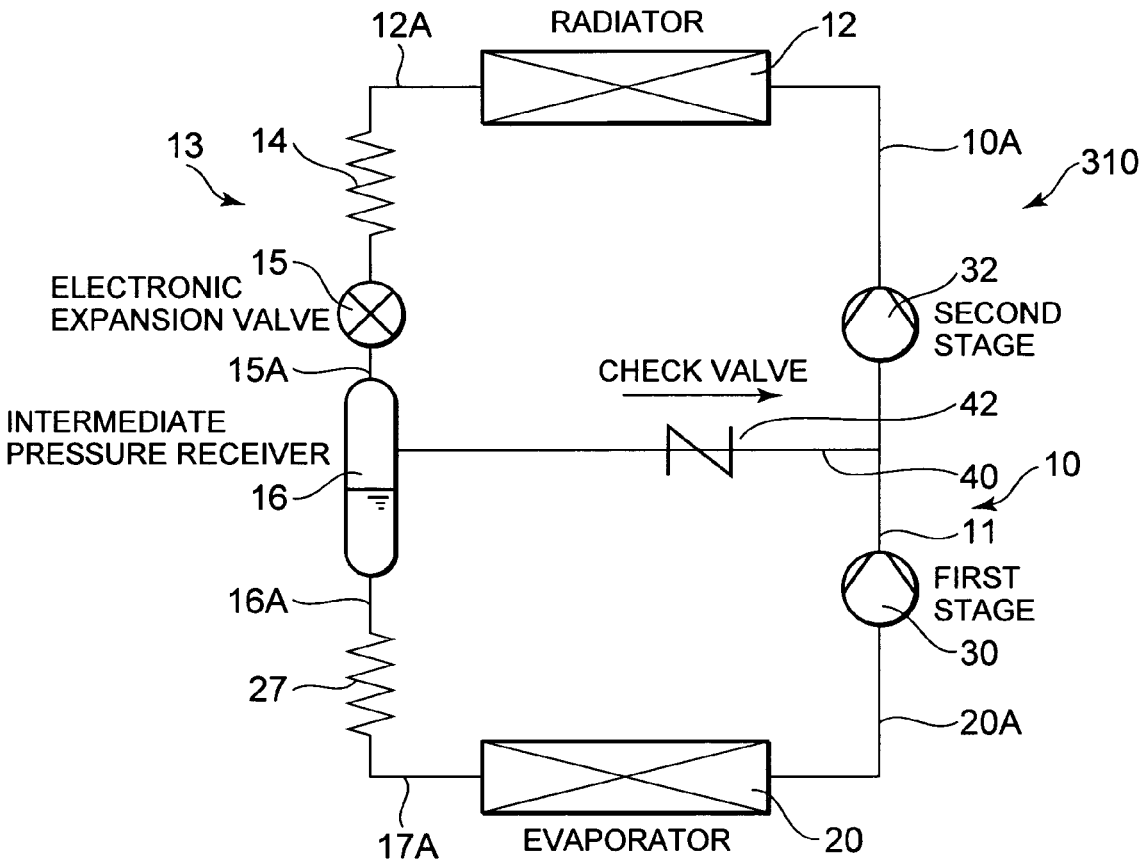
FIG. 4 is a refrigerant circuit diagram of a refrigerant cycle apparatus according to a third embodiment of the present invention.
Figure 5:
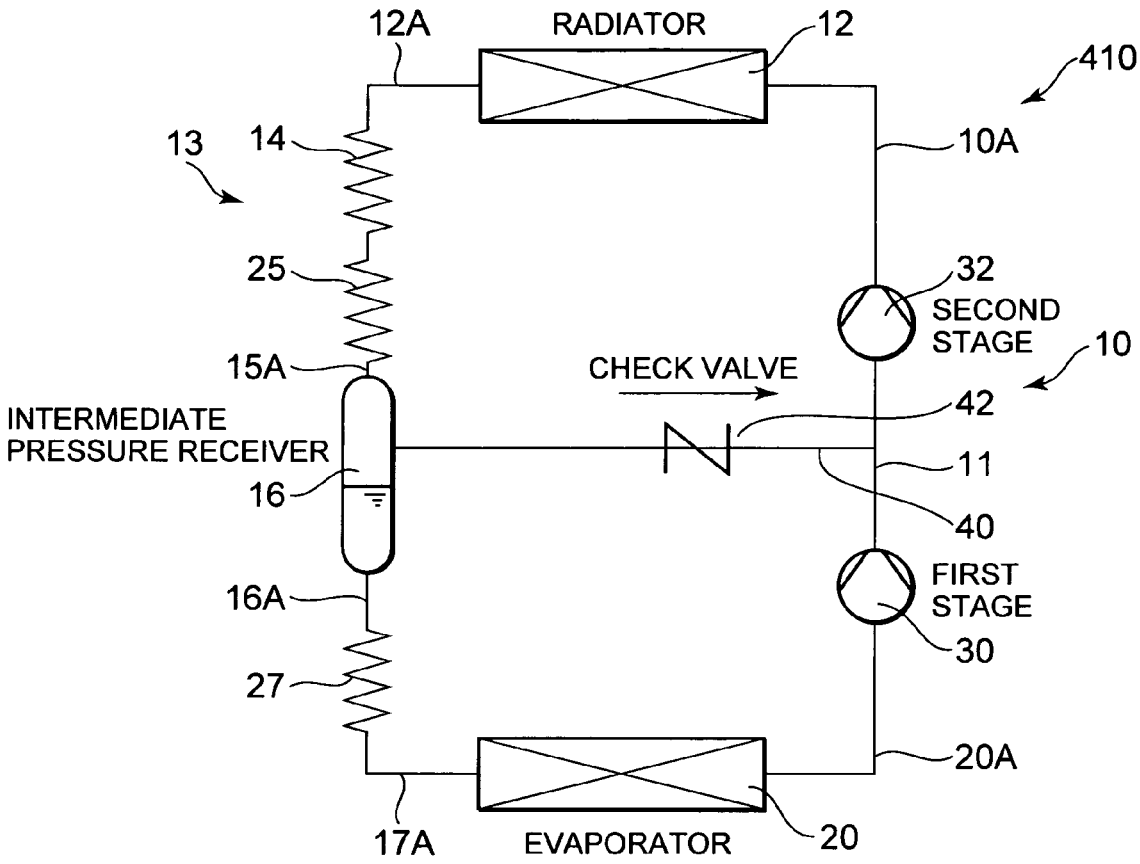
FIG. 5 is a refrigerant circuit diagram of a refrigerant cycle apparatus according to a fourth embodiment of the present invention.

FIG. 4 is a refrigerant circuit diagram of a refrigerant cycle apparatus 310 of the present embodiment. Reference numeral 27 denotes a capillary tube which is the second pressure reducing device. In FIG. 4, components denoted with the same reference numerals as those of FIGS. 1 and 3 produce identical or similar effects.

Even in the present embodiment, in the same manner as in the above-described embodiments, a refrigerant having a supercritical state is first pressure reduced by a capillary tube 14 having a small inner diameter, and accordingly the refrigerant can be sufficiently pressure reduced. Therefore, an appropriate control is possible by a usual electronic expansion valve 15 disposed on a downstream side of the capillary tube 14, and a pressure resistance of the expansion valve 15 may be low.

Embodiment 4

Moreover, the present invention is effective, even when both of throttling means of a first pressure reducing device, and a second pressure reducing device comprise capillary tubes. Even in the present embodiment, a refrigerant having a supercritical state is first pressure reduced by a capillary tube 14 having a small inner diameter, and therefore the refrigerant can be sufficiently pressure reduced. Therefore, a conventional capillary tube may be used in an inner diameter of a capillary tube 25 on a downstream side, without reducing an inner diameter of the tube or enlarging a dimension thereof.

Embodiment 5

Figure 6:
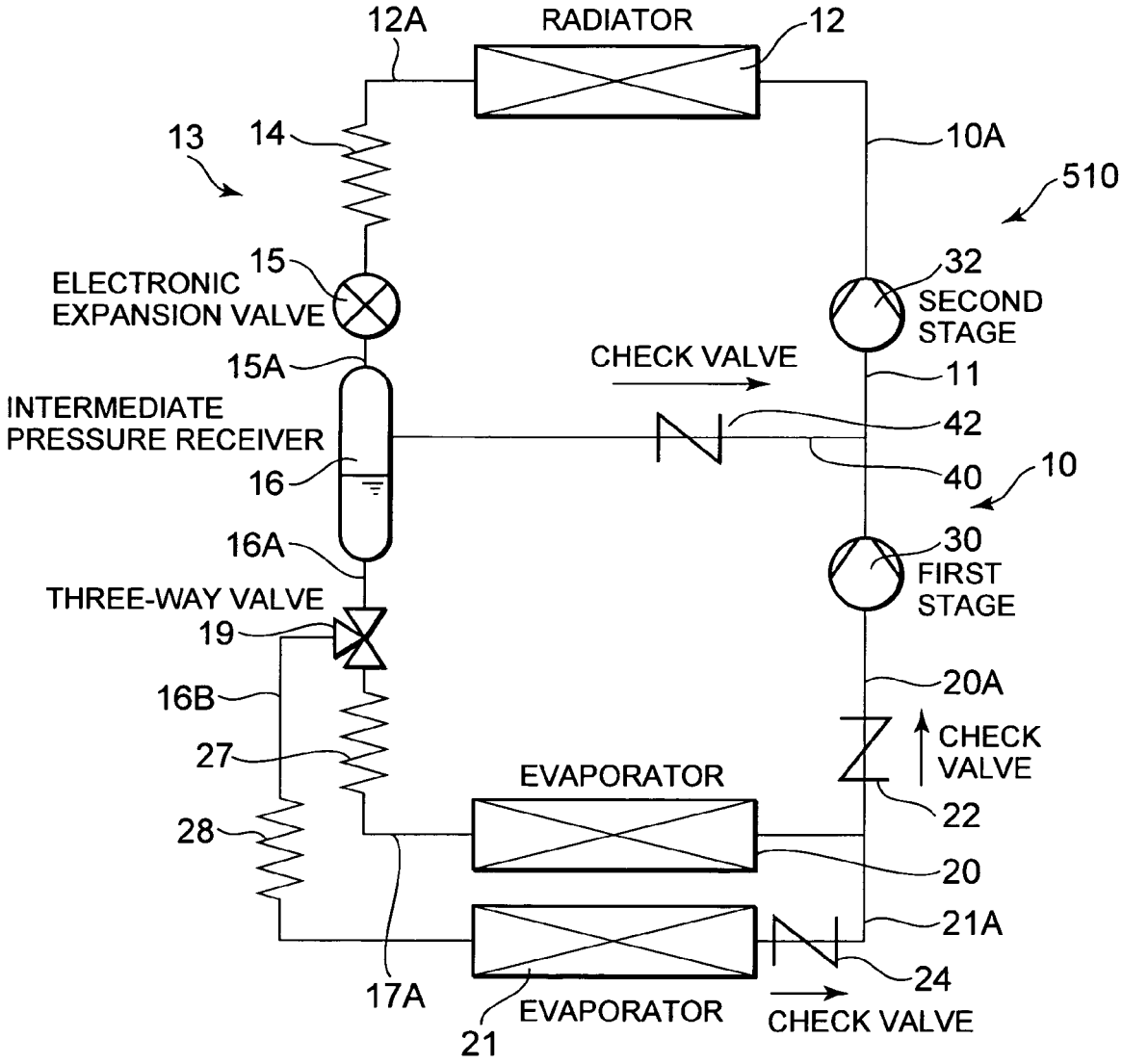
FIG. 6 is a refrigerant circuit diagram of a refrigerant cycle apparatus according to a fifth embodiment of the present invention.

It is to be noted that in the above-described embodiments, a refrigerant is evaporated by one evaporator 20, but a plurality of evaporators may be juxtaposed, and the refrigerant may be passed through the respective evaporators, and be evaporated. In the present embodiment, for example, as shown in FIG. 6, a branched pipe 16B is connected midway to a pipe 16A, and the branched pipe 16B is provided with a capillary tube 28 and an evaporator 21. A branched pipe 21A extending out of the evaporator 21 is connected to a middle portion of a refrigerant introducing tube 20A connected to an outlet side of an evaporator 20. Furthermore, the branched pipe 21A on the outlet side of the evaporator 21 is provided with a check valve 24, assuming that a refrigerant introducing tube 20A side is a forward direction. Similarly, the refrigerant introducing tube 20A is provided with a check valve 22, assuming that a compressor 10 side is a forward direction. Moreover, a three-way valve 19 is disposed in a position where the branched pipe 16B is connected. The three-way valve 19 executes an appropriate control in such a manner that a liquid phase refrigerant separated from a gas phase refrigerant in an intermediate pressure receiver 16 is discharged to either or both of a capillary tube 27 and the capillary tube 28. Consequently, the refrigerant can be evaporated selectively in the respective evaporators 20, 21.

Accordingly, when a refrigerant cycle apparatus 510 is used as an air conditioner for conditioning air in chambers, two chambers can be selectively cooled by the respective evaporators 20, 21. When the refrigerant cycle apparatus 510 is applied to a refrigerator or the like, two different spaces to be cooled can be simultaneously or selectively cooled. Therefore, versatility of the refrigerant cycle apparatus can be enhanced.

What is claimed is:

1. A refrigerant cycle apparatus in which a compressor, a radiator, a first pressure reducing device, an intermediate pressure receiver, a second pressure reducing device, and an evaporator are successively connected to one another in an annular form to constitute a refrigerant circuit and which is operated at a supercritical pressure on a high-pressure side, wherein the compressor has a first compression element and a second compression element which compresses a refrigerant compressed by the first compression element; a gas phase refrigerant in the intermediate pressure receiver is sucked into the second compression element of the compressor; a liquid phase refrigerant in the intermediate pressure receiver is pressure reduced by the second pressure reducing device and is then introduced into the evaporator;

wherein the first pressure reducing device comprises a capillary tube on an upstream side of the refrigerant and throttling means on a downstream side of the capillary tube; and wherein an inner diameter of the capillary tube is set to 0.1 mm or more and 0.4 mm or less.

2. The refrigerant cycle apparatus according to claim 1, wherein the throttling means of the first pressure reducing device comprises an expansion valve.

3. The refrigerant cycle apparatus according to claim 1, wherein the throttling means of the first pressure reducing device comprises a capillary tube.

4. The refrigerant cycle apparatus according to any one of claims 1, 2, or 3 wherein carbon dioxide is introduced as the refrigerant into the apparatus.

* * * * *